US009343217B2

(12) United States Patent
Golz

(10) Patent No.: US 9,343,217 B2
(45) Date of Patent: May 17, 2016

(54) ELECTROMAGNETIC POSITIONING DEVICE

(71) Applicant: ETO Magnetic GmbH, Stockach (DE)

(72) Inventor: Thomas Golz, Sipplingen (DE)

(73) Assignee: ETO Magnetic GmbH, Stockach (DE)

( * ) Notice: Subject to any disclaimer, the term of this patent is extended or adjusted under 35 U.S.C. 154(b) by 0 days.

(21) Appl. No.: 14/417,198

(22) PCT Filed: May 31, 2013

(86) PCT No.: PCT/EP2013/061306

§ 371 (c)(1),
(2) Date: Jan. 26, 2015

(87) PCT Pub. No.: WO2014/016023

PCT Pub. Date: Jan. 30, 2014

(65) Prior Publication Data

US 2015/0213937 A1 Jul. 30, 2015

(30) Foreign Application Priority Data

Jul. 26, 2012 (DE) ..... 10 2012 106 824

(51) Int. Cl.
*H01F 7/122* (2006.01)
*H01F 7/16* (2006.01)

(52) U.S. Cl.
CPC ..... *H01F 7/1623* (2013.01); *H01F 7/1615* (2013.01); *H01F 7/122* (2013.01)

(58) Field of Classification Search
CPC ..... H01F 7/1623; H01F 7/1615; H01F 7/122
USPC ..... 335/229–234
See application file for complete search history.

(56) References Cited

U.S. PATENT DOCUMENTS 4,550,302 A * 10/1985 Watanabe ..... H01F 7/1615 335/228
6,639,496 B1 * 10/2003 van Namen ..... E05B 47/00 335/229
8,493,166 B2 7/2013 Golz et al.

FOREIGN PATENT DOCUMENTS

| | | |
|---|---|---|
| DE | 20 2009 010 495 | 1/2010 |
| EP | 1 463 186 | 9/2004 |
| EP | 2 182 531 | 5/2010 |
| WO | 2010/018030 | 2/2010 |

OTHER PUBLICATIONS

German office action dated Apr. 18, 2013.
International search report dated Feb. 20, 2014.

* cited by examiner

*Primary Examiner* — Ramon M Barrera
(74) *Attorney, Agent, or Firm* — Bachman & LaPointe, PC

(57) ABSTRACT

An electromagnetic actuator with an armature unit (18) that can be driven relative to a stationary core unit (10) in reaction to the application of current to a stationary coil unit (14), which armature unit has a permanent magnetic agent (28) as well as a plunger unit (31), designed so as to interact with an actuation partner, guided out of a magnetically flux-conducting housing (35), wherein, on the outer surface of a shaft section (20) of the armature unit (18) a magnetically non-conducting bushing agent (32) is provided such that in a zero applied current state of the coil unit (14) a permanent magnetic flux (40) of the permanent magnetic agent (28) flows through the core unit (10) and the shaft section (20) so as to hold the armature unit (18) on the core unit (10), and in a state of the core unit (14) in which current is applied the permanent magnetic flux (40', 40") is displaced out of the core unit (10) into a housing section (50, 52) of the housing and a permanent magnetic flux circuit is closed by a section (54) of the plunger unit facing towards the housing.

12 Claims, 1 Drawing Sheet

ELECTROMAGNETIC POSITIONING DEVICE

BACKGROUND OF THE INVENTION

The present invention concerns an electromagnetic actuator.

Such a device is generally of known art for many actuation tasks, for example in conjunction with internal combustion engines, and is mass-produced. The applicant's German utility model 20 2009 010 495 shows such an electromagnetic actuator, presupposed to be of generic form, in which an elongated plunger as a plunger unit is part of a multi-part armature unit of radially symmetric design; the latter can in turn be driven relative to a stationary core unit, by applying current to a stationary coil unit, so as to move the plunger. The plunger unit in turn engages on its end face with an actuation partner, which in the example of embodiment is a groove effecting a camshaft adjustment in an internal combustion engine.

Such established devices, presupposed to be of a generic form, combine a high level of operational reliability and low wear with favourable electromagnetic and production properties, wherein in particular the latter make the technology of known art suitable for mass production. However in such devices it is necessary, at least partially, i.e. in some sections, to enclose the stationary core region up to the permanent magnet unit of the armature unit; in specific implementations of the technology in accordance with DE 20 2009 010 495 this has been implemented in terms of housing elements in the form of a yoke. In particular in the case of installation volumes where space is critical, such as, for example, in the vicinity of an internal combustion engine camshaft, such flux-conducting parts of the housing limit the minimum installation dimensions that can be achieved, and predetermine de facto a minimum separation distance, for example, between a multiplicity of actuators to be provided adjacent to one another. Accordingly a need exists for a housing structure that can be implemented in a compact form, particularly in the radial direction.

A further disadvantage of the generic technology cited, which is in need of improvement, consists in the fact that in a zero applied current, stop-limited state of the armature unit (typically with the plunger unit in the retracted state) the detention forces that hold the armature unit in the core region are limited. Accordingly there is no possibility (or only a very limited possibility) of providing a compression spring, or similar energy store, between the armature unit and the core unit, with which, for purposes of achieving high dynamic properties (corresponding, for example to a high initial acceleration of the armature unit) when current is applied, the armature unit can be driven out of its stop-limited, i.e. stationary, position. In this respect the holding forces in the stationary state determine the maximum spring force that can be utilised in this situation. Accordingly from this perspective it is desirable to increase the holding forces of the armature unit on the stationary core region (core unit), generated by a permanent magnetic agent, so that in this respect it is possible to enable a more effective spring-assisted movement of the armature.

SUMMARY OF THE INVENTION

The object of the present invention is therefore to improve a generic electromagnetic actuator both with regard to its dynamic properties, in particular its movement—and acceleration behaviour when current is applied, and also to configure the device more compactly in the radial direction, with the objective of reducing the minimum separation that is possible between the plunger units, adjacent to one another, of a multiplicity of actuators provided adjacent and parallel to one another.

The object is achieved by the electromagnetic actuator with the features disclosed herein. Advantageous developments of the invention are also described herein.

In an inventively advantageous manner a magnetic flux path is created by the magnetically non-conducting bushing agent provided on the outer surface of a shaft section of the armature unit, such that in the zero applied current (stop-limited) state of the armature unit the permanent magnetic flux of the permanent magnetic agent provided in the armature unit flows so as to close a permanent magnetic flux circuit, both through the shaft section (of the armature unit), and also, radially outwards, through the radially enclosing core region, wherein the said permanent magnetic flux path in the zero applied current state is further preferably configured such that the permanent magnetic flux flows around the bushing (which in accordance with the invention is magnetically non-conducting).

An advantageous result in the context of the invention is a good permanent magnetic detention of the armature unit on the core unit in the zero applied current state, since, in this respect in contrast to the generic DE 20 2009 010 495, an axially operative working air gap can be created between a section of the armature unit and an end of the core unit without additional components with a small air gap. An advantage of this improved permanent magnetic detention force is the possibility, for purposes of improving the movement, i.e. dynamic, properties of the device, of pre-loading the armature unit by means of a suitable spring agent, which can further preferably be configured as a spiral- and/or compression spring, against the core region, or another stationary section.

If in accordance with the invention there then advantageously takes place, by applying current to the coil unit, a displacement of the permanent magnetic flux out of the core unit and into a (magnetically conducting) housing section, which interacts with the plunger unit, the said compression spring, in addition to the (electro)magnetic repulsion, can accelerate the armature unit and can thus improve the dynamic behaviour of the armature unit in the desired manner.

To this end, in accordance with the invention, the plunger unit, in particular at its end directed towards the permanent magnetic agent, is advantageously included in the magnetic flux path and thus in particular makes it possible, in a geometrically advantageously and space-saving manner with regard to radial installation volume, for the lateral housing—i.e. flux-conducting, sections that were necessary in the generic prior art to be eliminated.

At the same time, in accordance with development in a particular advantageous implementation of the invention, it is particularly advantageous for the spring agent configured as a spiral- and/or compression spring to be integrated into an end section of the armature unit (more exactly: into the shaft section of the armature unit), such that here additional action can be taken to save space; typically it is possible to insert such an advantageously to be deployed spiral spring, without any disadvantages in magnetic efficiency, into, for example, an internal widening of the shaft section end face, and to support it at one end on a corresponding internal annular step in the armature unit, and on the other end on a stationary section of the core.

It is particularly preferable within the context of the invention for the plunger unit of elongated configuration, implemented, at least in the direction towards the permanent magnetic agent, from a suitable soft magnetic and/or magnetically conducting material, to be provided in a detachable manner on the shaft section of the armature unit, with the result that the armature unit is implemented in multiple parts (shaft section, plunger unit). In this form of implementation it is particularly preferable to design an end section of the shaft section, provided so as to interact with the related end of the plunger unit, in a suitably flat and/or radially widened manner, wherein in the practical implementation this can advantageously be implemented, for example, in terms of a disk-shaped flux-conducting section, the end of which sits on the permanent magnetic unit (as a permanent magnetic agent, which in accordance with development is again ring- and/or disk-shaped).

In particular such a configuration enables, by means of a permanent magnetic action, in accordance with development solely by means of the permanent magnetic action of the permanent magnetic agent, which is anyway present on the armature side, the plunger unit to be detainable in a detachable manner on the end section of the shaft section, such that maximum flexibility, combined with options for tolerance compensation, can be implemented in the installed- and operating states. Additionally or alternatively it is conceivable to configure the plunger unit itself (in at least some sections) in a permanent magnetic manner, in order to implement such a magnetic detention action.

The permanent magnetic agent, preferably attached on or in the armature unit in a non-detachable manner, is manufactured from a suitable permanent magnetic material and is axially magnetised, i.e. in a direction of magnetisation, which runs parallel to the direction of movement of the armature unit and also to a longitudinal axis through the shaft section of the armature unit.

For purposes of inventive inclusion of the plunger unit (i.e. an end section of the plunger unit) in a magnetic flux circuit when current is applied to the coil unit—in this operating state the permanent magnetic flux of the permanent magnetic unit is displaced such that it forms a closed (permanent magnetic) flux circuit via a section of the housing and a permanent magnetic side end region of the plunger unit—the housing, at least in the region of the plunger unit, is advantageously and developmentally configured such that it possesses the form of a cup or yoke, and/or radially encloses the shaft section (which in this region is further advantageously radially widened) in the outer region. An air gap to the plunger unit can, for example, preferably be formed in that the housing section, for purposes of guiding through the (elongated) plunger unit, provides a suitable aperture matched to an outer diameter of the plunger unit, and thus the inventive displaced permanent magnetic flux can not only act as a flux circuit for the state of the coil unit in which current is applied, but additionally and advantageously, the stop for the extended state of the armature unit can be created by the housing section, in particular an end face housing section; also in this extended, stop-limited state of the armature unit the permanent magnetic flux circuit is inventively closed via the housing section, the section of the plunger unit and, if necessary, an additional flux-conducting section of the armature unit, facing away axially from the plunger unit (relative to the permanent magnetic agent), such that even when the coil unit is once again in the zero applied current state, in this extended stop-limited state a stable stop position can be achieved; in this respect a bi-stable switching behaviour of the device can be achieved.

In a manner that is constructively particularly simple and favourable for automated manufacture, the bushing agent, implemented, for example, as a hollow cylindrical bushing, manufactured from steel 1.4301, is pressed into the core section, such that not only a mechanically robust and non-detachable bonding ensues, but also a section of the bushing projects from, or out of, the core region with the possibility that the bushing can then not only be enclosed internally by the armature unit, but also externally by the armature unit on this projecting section. In a constructively elegant manner this in turn enables the implementation of the inventive principle of a path of the permanent magnetic flux of the permanent magnetic agent around the bushing (more exactly: the bushing wall) in the zero applied current state of the coil unit.

The result is that the present invention enables the development, in a surprisingly simple and elegant manner, of a generic electromagnetic actuator, with regard to a reduced diameter in the core region and improved dynamic, i.e. acceleration properties, so that in particular in a particularly preferred field of application of the present invention, namely the control of the functionality of an internal combustion engine, novel and additional advantageous possible uses are introduced. Nevertheless the present invention is not limited to the "engine technology" field of application; rather the inventive device is suitable for any form of deployment in which electromagnetic actuation technology that is simple to manufacture, and is, at the same time, efficient, is to be combined with advantageous flux path properties.

BRIEF DESCRIPTION OF THE DRAWINGS

Further advantages, features, and details of the invention ensue from the following description of preferred examples of embodiment, and also with the aid of the drawings; in the latter.

DETAILED DESCRIPTION

Figure 1:
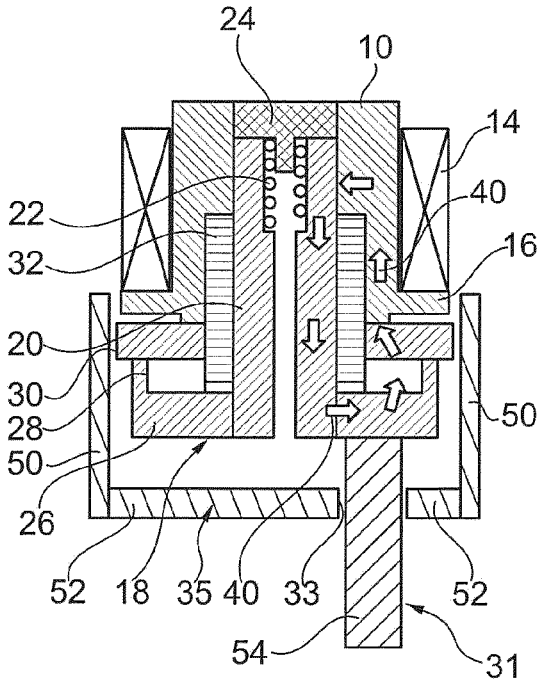
FIG. 1 shows a schematic longitudinal sectional view through the electromagnetic actuator in accordance with a first form of embodiment of the invention, in a zero applied current operating state of the coil unit.
Figure 2:
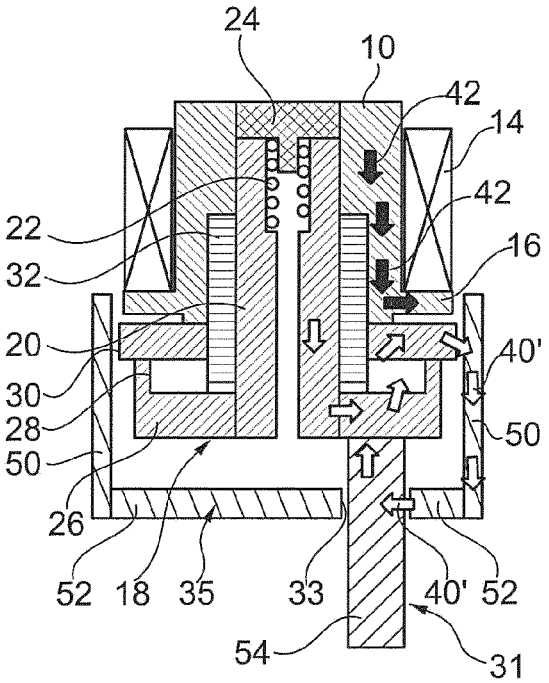
FIG. 2 shows a representation analogous to FIG. 1 at a point in time at which current is being applied to the coil unit, but the armature unit is still located in the initial stop-limited state.
Figure 3:
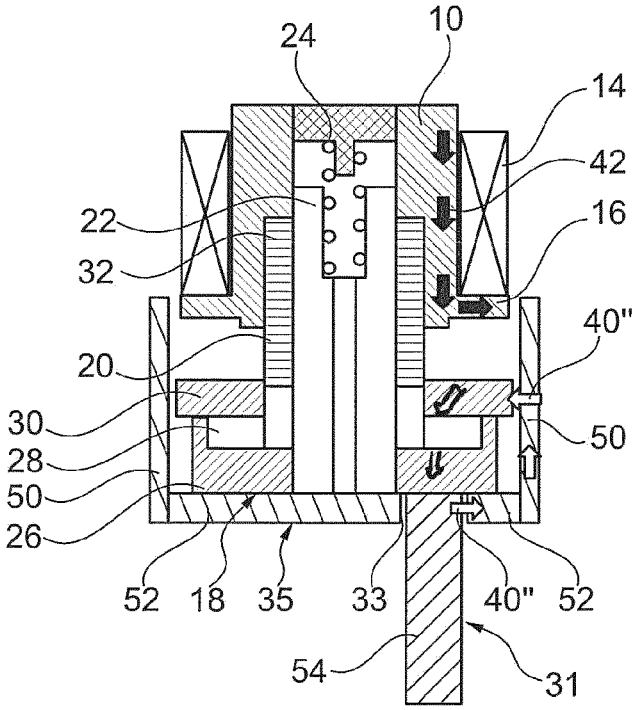
FIG. 3 shows a representation of the actuator analogous to FIG. 1 and FIG. 2 in the state of the coil unit in which current is being applied, at a point in time after the state in FIG. 2, with the armature unit moved into a position in which it abuts against an opposite housing stop, with the plunger unit in an advanced, i.e. extended, position.

FIGS. 1 to 3 show in schematic longitudinal section views the inventive electromagnetic actuator in a preferred form of embodiment of the invention; the reference symbols apply to all representations.

In this respect corresponding to the generic technology of DE 20 2009 010 495 the device, built with radial symmetry, consists of a stationary (i.e. installed and itself immovable) core unit 10, which on its end face forms a base section 12 and on its outer surface is enclosed by a coil unit 14 held on a coil support (not shown).

An armature unit 18 is designed such that it is immersed by means of a shaft section 20 in the core unit 10, which on its end face opposite the base section 12 is widened by means of a flange region 16, wherein the shaft section, in the direction towards the base 12, has a radial widening 22 of an axial aperture, into which widening is inserted a spiral spring 24, which is supported on the base element 12 so as to pre-load the armature unit with its spring force.

At the other end the shaft section 20 of the armature unit 18 has a widened section 26 in the form of a flange, on which is set an annular permanent magnet 28, axially magnetised in a direction running parallel to the longitudinal extent of the shaft section 20, so that the widened section 26 in the form of a flange, together with a further flange section 30 of the armature unit, act on both sides of the permanent magnet ring as flux-conducting elements.

An elongated cylindrical plunger unit 31, implemented in soft iron, sits, magnetically detained, externally on the flange section 26 and passes through an aperture 33 in a housing 35 (it can also sit directly in a guide tube).

On the outer surface of the shaft section 20 a hollow cylindrical bushing 32 of steel 1.4301 is pressed into the core unit 10 such that on the inner face of the bushing the latter sits such that the full surface of the bushing slides on an outer section of the shaft section 20; in the outer region of the bushing 32 an axial longitudinal section is formed in terms of a press fit with the material of the core unit 10, and a further axial longitudinal section of the bushing, axially adjacent, is overlapped by the armature unit, in particular the flux-conducting section, the permanent magnet unit 28 and the section 26.

In a zero applied current state of the coil unit 14, as is made clear by the set of arrows 40 in FIG. 1, the result is a permanent magnetic flux of the permanent magnetic agent 28 being closed so as to form a flux circuit through the flux-conducting disk 30, the core unit 10, the elongated shaft section 20 in the interior of the bushing and the flux-conducting section 26, which at the air gap and armature/stator transition point (from 10 to 30) causes a strong permanent magnetic detention.

Here the device is dimensioned and equipped such that in this operating state the permanent magnetic detaining force is higher than the compression force of the spiral spring 24 acting on the armature unit.

FIG. 2 shows the state of the coil unit with current applied, immediately after the activation of the current. The set of arrows 42 illustrates the electromagnetically generated coil magnetic field (once again in the interests of simplification arrows are shown on just one side of the radially symmetric device), wherein the arrows 42 displace the permanent magnetic flux 40' out of the core unit 10, into a permanent magnetic flux circuit, which is now formed from the flux-conducting element 30, a radially enclosing, cup-shaped housing section 50 of the housing 35, into a housing cover section 52 set on the housing, into an end section 54 of the plunger unit facing towards the permanent magnet, and via the flux-conducting section 26 through to the axially magnetised permanent magnetic ring 28.

In this operating state thereby the electromagnetic flux 42 not only acts so as to repel the armature unit, but also as a result of the flux displacement the permanent magnetic detention of the armature unit on the core unit is overcome, and the compression spring 24 now acts on the armature unit to provide additional acceleration so as to drive the plunger unit out of the housing 35 (the direction of movement is downwards in the drawing plane of FIGS. 1 to 3).

FIG. 3 shows the final state of this drive movement, with current applied to the coil unit now as before, and a partially decompressed spiral spring 24: The housing section 52 forms on its inner face the stop for the armature unit 18, the flux-conducting section 26 of which abuts against the suitably magnetically conductive, e.g. soft magnetic, material. As is moreover made clear by the set of arrows 40", in this extended state of the plunger unit the armature unit is held—bi-stably—by means of a permanent magnetic flux circuit, which extends in a closed manner through the armature arrangement made up from the flux-conducting element 30, the permanent magnetic ring 28, the flux-conducting element 26, via the flux-conducting end 54 of the plunger unit 35, and the housing sections 52, 50. In the typical application of camshaft adjustment a suitably actuation partner of the plunger element engaging in an opposed manner with the end 54 would then be able to restore the armature unit into its initial position (FIG. 1).

The present invention is not limited to the example of embodiment shown, instead numerous further variants and configurations for particular applications can be conceived, in which in accordance with the invention the permanent magnetic flux diversion or displacement can result in an enhancement of the dynamic behaviour.

The invention claimed is:

1. An electromagnetic actuator with an armature unit (18) that can be driven relative to a stationary core unit (10) in reaction to the application of current to a stationary coil unit (14), which armature unit has a permanent magnetic agent (28) as well as a plunger unit (31), designed so as to interact with an actuation partner, guided out of a magnetically flux-conducting housing (35), wherein, on the outer surface of a shaft section (20) of the armature unit (18) a magnetically non-conducting bushing agent (32) is provided such that in a zero applied current state of the coil unit (14) a permanent magnetic flux (40) of the permanent magnetic agent (28) flows through the core unit (10) and the shaft section (20) so as to hold the armature unit (18) on the core unit (10), and in a state of the core unit (14) in which current is applied the permanent magnetic flux (40', 40") is displaced out of the core unit (10) into a housing section (50, 52) of the housing and a permanent magnetic flux circuit is closed by a section (54) of the plunger unit facing towards the housing.

2. The device in accordance with claim 1, wherein a spring agent (24), which for purposes of exerting a spring force driving the armature unit (18) engages with the armature unit (18).

3. The device in accordance with claim 2, wherein the spring agent, designed as a spiral and/or compression spring (24), is provided on the end face of the shaft section (20), and/or is accommodated in an end section of the shaft section (20).

4. The device in accordance with claim 1, wherein the plunger unit (31) is provided in a detachable manner on a planar flange- and/or end section (26) of the shaft section (20).

5. The device in accordance with claim 1, wherein the plunger unit is provided in a magnetically detained manner on the shaft section (20).

6. The device in accordance with claim 1, wherein the permanent magnetic agent (28) is provided on an end region of the shaft section (20) facing towards the plunger, and/or is designed in the form of a ring and/or disk.

7. The device in accordance with claim 1, wherein the shaft section (20) is designed such that it is radially widened at the end facing towards the plunger, and/or provides a flux-conducting section for a permanent magnetic flux of the permanent magnetic agent (28).

8. The device in accordance with claim 1, wherein the housing section (50, 52) is designed in the form of a cup and/or yoke, and/or radially encloses at least some sections of the shaft section (20).

9. The device in accordance with claim 1, wherein the bushing agent (32) is connected in a non-detachable manner with the core unit (10), which is implemented from a soft magnetic material, by means of a press fit process.

10. The device in accordance with claim 1, wherein no magnetic conducting element is provided on the outer surface of, and/or radially adjacent to, the coil unit (14).

11. The device in accordance with claim 5, wherein the plunger unit is provided in a permanent magnetically detained manner.

12. The device in accordance with claim 7, wherein the shaft section (20) provides a radially oriented flux-conducing section.

* * * * *